US009436164B2

(12) United States Patent
Sano

(10) Patent No.: US 9,436,164 B2
(45) Date of Patent: Sep. 6, 2016

(54) RADIO-CONTROLLED TIMEPIECE

(71) Applicant: CASIO COMPUTER CO., LTD., Shibuya-ku, Tokyo (JP)

(72) Inventor: Takashi Sano, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/283,949

(22) Filed: May 21, 2014

(65) Prior Publication Data

US 2014/0355392 A1 Dec. 4, 2014

(30) Foreign Application Priority Data

May 28, 2013 (JP) ..... 2013-111433

(51) Int. Cl.
*G04R 20/10* (2013.01)
*G04G 3/04* (2006.01)

(52) U.S. Cl.
CPC ..... *G04R 20/10* (2013.01); *G04G 3/04* (2013.01)

(58) Field of Classification Search
CPC ..... G04C 11/02; G04G 3/04; G04R 20/00; G04R 20/04; G04R 20/10; G04R 20/16; G04R 20/22; G04R 40/04
USPC ..... 368/46, 47
See application file for complete search history.

(56) References Cited

U.S. PATENT DOCUMENTS 6,768,704 B1 * 7/2004 Kawaguchi et al. ..... 368/203
7,307,919 B2 * 12/2007 Fujisawa et al. ..... 368/47
2006/0023572 A1 * 2/2006 Someya ..... 368/47
2006/0050824 A1 * 3/2006 Kondo ..... 375/354
2009/0160569 A1 6/2009 Gros
2009/0257321 A1 * 10/2009 Scott et al. ..... 368/200
2010/0074059 A1 * 3/2010 Hasumi et al. ..... 368/47
2010/0220006 A1 * 9/2010 Arab et al. ..... 342/357.12
2012/0008466 A1 * 1/2012 Tokiwa et al. ..... 368/47
2012/0014226 A1 * 1/2012 Tokiwa et al. ..... 368/47
2012/0294126 A1 11/2012 Sano et al.

FOREIGN PATENT DOCUMENTS

JP 2008-215929 A 9/2008
JP 2012-242194 A 12/2012

OTHER PUBLICATIONS

Extended European Search Report dated Jan. 4, 2016, issued in counterpart European Application No. 14170022.9.

* cited by examiner

*Primary Examiner* — Amy Cohen Johnson
*Assistant Examiner* — Matthew Powell
(74) *Attorney, Agent, or Firm* — Holtz, Holtz & Volek PC

(57) ABSTRACT

Disclosed is a radio-controlled timepiece. The radio-controlled timepiece includes an oscillating unit, a display unit, a display driving unit, an error storage unit, a radio wave receiving unit, and a frequency setting unit. The display driving unit drives the display unit with a driving signal of a predetermined driving waveform frequency generated by the clock signal output by the oscillating unit. The error storage unit stores error data of an oscillating frequency. The radio wave receiving unit tunes to a receiving frequency of a radio wave including time information, and receives the radio wave. The frequency setting unit sets the driving waveform frequency based on the error data so that the receiving frequency does not overlap with a higher order harmonic wave of the driving waveform frequency during a period that the radio wave is received.

4 Claims, 6 Drawing Sheets

(COM WAVEFORM)

(COM WAVEFORM)

(COM WAVEFORM)

(COM WAVEFORM)

(SEG WAVEFORM)

(OUTPUT WAVEFORM)

(OUTPUT WAVEFORM)

(OUTPUT WAVEFORM)

FIG.4I (OUTPUT WAVEFORM)

FIG.5

| THINNING SETTING | DESTINATION FREQUENCY |
|---|---|
| 0-50 ppm | 74.0 Hz |
| 51-100 ppm | 74.2 Hz |

RADIO-CONTROLLED TIMEPIECE

BACKGROUND OF THE INVENTION

1. Field of the Invention

The present invention relates to a radio-controlled timepiece.

2. Description of the Related Art

Conventionally, there has been an electronic timepiece (radio-controlled timepiece) which includes functions to receive a radio wave (standard radio wave) including time information represented by a predetermined format (time code), to obtain time data, and to calibrate the time of an internal clock.

Among such radio-controlled timepieces, electromagnetic noise is generated by change of electric current or voltage in a driving signal of a liquid crystal in digital radio-controlled timepieces with a display using a digital display screen such as a liquid crystal display (LCD). When electromagnetic noise is mixed in receiving radio waves when the standard radio wave is received, the quality of the demodulated time code is damaged.

In view of the above, conventionally, techniques are developed in digital radio-controlled timepieces, such as a technique to pause driving of the liquid crystal while the standard radio wave is being received, or a technique to control operation so that the timing of discretely sampling the time code signal is different from the timing of driving the liquid crystal (for example, Japanese Patent Application Laid-Open Publication No. 2008-215929).

Moreover, since the electromagnetic noise generated by driving the digital display screen appears in higher order harmonic frequencies of the driving frequency, there is also a technique where the driving frequency is set so that the driving frequency of the digital display screen and its higher order harmonic frequencies do not overlap with the transmitted frequency of the standard radio wave (for example, Japanese Patent Application Laid-Open Publication No. 2012-242194 (corresponding to US 2012/0294126 A1).

Various differences occur in the oscillating frequency of the clock signal regarding driving the digital display screen due to characteristics of the oscillating circuit. In electronic timepieces, the time is kept by counting a clock signal or a predetermined frequency signal based on the clock signal. Therefore, if the oscillating frequency is different from the desired frequency, in other words, if there is an error, the accuracy of the time reduces according to the amount of deviation. Conventionally, in order to remove influence of such deviation, there are electronic timepieces which perform a logical slowing/quickening operation to thin input of signals to be counted in a percentage according to the deviation. The data which determines the percentage of thinning in the logical slowing/quickening operation is obtained in advance by testing before the electronic timepiece is shipped from the manufacturer, and the data is stored in the ROM.

However, usually, strict frequency accuracy is not required in the clock signal used for driving the digital display screen, and conventionally, signals including the deviation are used as they are. Therefore, even if the oscillating frequency is set based on the conventional techniques so that the oscillating frequency and its higher order harmonic frequencies are different from the receiving frequency of the radio wave including the time information, one of the oscillating frequency and its higher order harmonic frequencies overlaps with the receiving frequency due to the deviation of the oscillating frequency. Therefore, the signal of the time information may be damaged and it may not be possible to reliably receive the signal.

SUMMARY OF THE INVENTION

The present invention has been conceived in view of the above problems, and one of the main objects is to provide a radio-controlled timepiece which is able to receive a radio wave including time information easily and more reliably while continuing digital display.

According to an aspect of the present invention, there is provided a radio-controlled timepiece including:

an oscillating unit which outputs a clock signal;

a display unit which displays with a digital display;

a display driving unit which drives the display unit with a driving signal of a predetermined driving waveform frequency generated by the clock signal;

an error storage unit which stores error data of an oscillating frequency of the clock signal;

a radio wave receiving unit which tunes to a receiving frequency of a radio wave including time information, and receives the radio wave; and a frequency setting unit which sets the driving waveform frequency based on the error data so that the receiving frequency of the radio wave does not overlap with a higher order harmonic wave of the driving waveform frequency during a period that the radio wave is received by the radio wave receiving unit.

BRIEF DESCRIPTION OF THE DRAWINGS

The present invention and the above-described objects, features and advantages thereof will become more fully understood from the following detailed description with the accompanying drawings and wherein;

FIG. 4A to FIG. 4I are diagrams describing a control signal and a driving signal regarding duty driving;

FIG. 5 is a table describing a table of changing setting of a driving frequency.

DETAILED DESCRIPTION OF THE PREFERRED EMBODIMENTS

An embodiment of the present invention is described with reference to the drawings.

Figure 1:
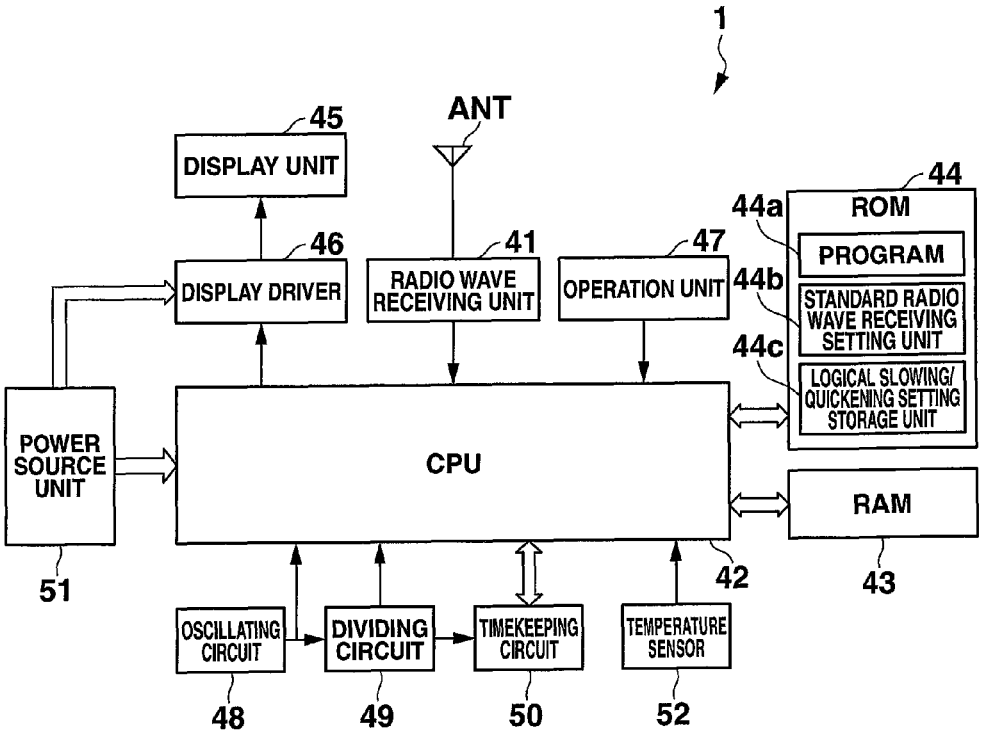
FIG. 1 is a block diagram showing a radio-controlled timepiece of an embodiment of the present invention.
Figure 2:
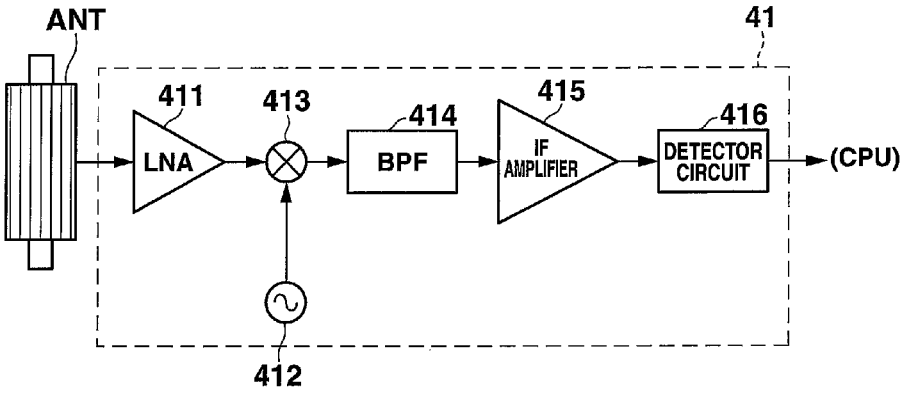
FIG. 2 is a block diagram describing a circuit configuration of a radio wave receiving unit.

FIG. 1 is a block diagram showing an internal configuration of a radio-controlled timepiece 1 of the present embodiment. FIG. 2 is a block diagram showing an internal configuration of a radio wave receiving unit.

The radio-controlled timepiece 1 of an embodiment of the present invention is a digital radio-controlled timepiece which is able to display the time with a digital display on a liquid crystal display. The radio-controlled timepiece 1 can be any type of electronic timepiece such as a watch, a table clock, a wall clock or a pocket watch. Alternatively, the radio-controlled timepiece 1 can be various digital display devices including a function as a radio-controlled timepiece.

The radio-controlled timepiece 1 includes an antenna ANT and a radio wave receiving unit 41, a CPU (Central Processing Unit) 42 (frequency setting unit), a RAM (Random Access Memory) 43, a ROM (Read Only Memory) 44, a display unit 45, a display driver 46 (display driving unit), an operation unit 47, an oscillating circuit 48 (oscillating unit), a frequency dividing circuit 49, a time keeping circuit 50 (time keeping unit), a power source unit 51, and a temperature sensor 52 (temperature measuring unit).

The radio wave receiving unit 41 demodulates a time code signal from a standard radio wave received using the antenna ANT which receives a radio wave of a long wavelength band. The standard radio wave is an amplitude modulated wave (AM wave) of a long wavelength band. Although not limited to the system below, the radio wave receiving unit 41 of the present embodiment demodulates using, for example, a superheterodyne system. The radio wave receiving unit 41 turns on only when the standard radio wave is received according to an instruction from the CPU 42. The tuning frequency of the antenna ANT can be changed by adjusting the setting of a tuning circuit not shown in the radio wave receiving unit 41.

The radio wave receiving unit is composed of the radio wave receiving unit 41 and the antenna ANT.

As shown in FIG. 2, the radio wave receiving unit 41 includes an LNA (low noise amplifier) 411, a local oscillator 412, a mixer 413, a BPF (narrow band pass filter) 414, an IF (intermediate frequency) amplifier 415, and a detector circuit 416. The radio wave receiving unit 41 uses the LNA 411 to amplify the receiving signal of the standard radio wave (for example, 40 kHz or 60 kHz from the JJY which is the standard radio wave transmitting station of Japan) corresponding to the tuning frequency of the antenna ANT. After the signal is converted to the signal of the intermediate frequency with the mixer 413, the signal within the predetermined frequency range (for example, within the range of about ±10 Hz) is selectively passed through the BPF 414. The signal which passes through the BPF 414 is amplified by the IF amplifier 415, and then the signal is demodulated with the detector circuit 416 to be output as the time code signal.

The radio wave receiving unit 41 further includes an ADC (analog/digital convertor) (not shown) which binarizes the demodulated time code signal with a predetermined sampling frequency and outputs the result to the CPU 42 as TCO (time code output).

Multi value data can be output depending on the method to decode the time data from the time code signal in the CPU 42. An analog signal can be directly binarized by using a comparator. Although not limited, the output of the TCO is to be a low level voltage signal when larger than a predetermined reference voltage set in the ADC, and is to be a high level voltage signal when smaller than the reference voltage.

The CPU 42 centrally controls the entire operation of the radio-controlled timepiece 1. When the TCO is input from the radio wave receiving unit 41, the CPU 42 decodes and obtains the time data from the TCO. Various conventional techniques can be used as the method to decode the time data and the method to enhance sensitivity in decoding. The CPU 42 transmits a signal to the time keeping circuit 50 based on the obtained time data to calibrate present time data held by the time keeping circuit 50.

The RAM 43 provides memory space for working to the CPU 42. The RAM 43 stores receiving time of the standard radio wave and setting data regarding the standard radio wave transmitting station where reception is first attempted in a state that can be overwritten.

The ROM 44 stores various programs for the radio-controlled timepiece 1 to perform various operations and initial setting data. A program 44*a* for receiving the standard radio wave and calibrating the time is included in the programs stored in the ROM 44. When there is an instruction based on a set time stored in the RAM 43 or input of operation from the operation unit 47 to execute the program 44*a*, the CPU 42 loads the program 44*a* on the RAM 43 to execute the program 44*a*. The ROM 44 includes a standard radio wave receiving setting unit 44*b* (change setting storage unit) and a logical slowing/quickening setting storage unit 44*c* (error storage unit).

Transmitting frequencies of standard radio wave transmitting stations throughout the world which can be received by the radio-controlled timepiece 1, formats of the time code, code patterns, and driving waveform frequency (destination frequency) which drives the display unit 45 during the period that the radio wave of the standard radio wave transmitting station is received or frame frequency are stored associated with each other as table data in the standard radio wave receiving setting unit 44*b*.

The logical slowing/quickening setting storage unit 44*c* stores data regarding thinning setting (error) when logical slowing/quickening is applied to the clock signal from the oscillating circuit 48. Other than an amount of the deviation unique to the oscillating circuit 48 (static error), the data can include a value (variable error) of a coefficient in a formula showing the deviation which changes depending on the temperature or a formula set in advance.

The operation unit 47 includes a plurality of keys and buttons, and when these keys and buttons are operated, the content of the operation is converted to an electric signal to be output to the CPU 42 as an input signal.

The oscillating circuit 48 outputs, for example, an oscillating signal (clock signal) of 32 kHz. Although not limited, the oscillating circuit 48 includes, for example, a small type crystal oscillator which has low power consumption and which does not include a temperature compensation circuit.

The frequency dividing circuit 49 divides the oscillating signal, generates a signal with the necessary frequency, and outputs the signal. According to an instruction from the CPU 42, the frequency dividing circuit 49 is able to suitably switch the dividing ratio to output a signal with a different frequency. The frequency dividing circuit 49 performs thinning operation of the signal regarding the logical slowing/quickening according to the control signal input from the CPU 42 based on the setting in the logical slowing/quickening setting storage unit 44*c* of the ROM 44.

Figure 3:
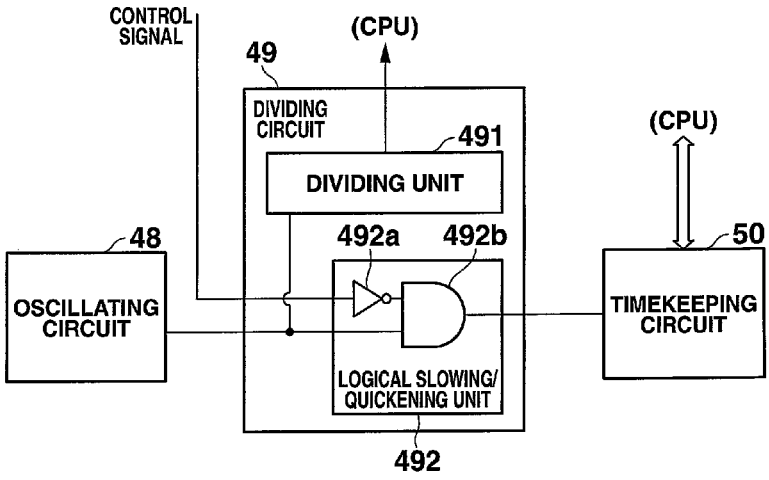
FIG. 3 is a diagram describing an adjusting unit of a clock signal.

FIG. 3 is a diagram showing a configuration regarding output of a clock signal from the oscillating circuit 48.

The clock signal of the oscillating frequency output from the oscillating circuit 48 is output of a rectangular wave including a high level signal and a low level signal for each clock cycle. The clock signal input to the frequency dividing circuit 49 is divided into two systems. One signal is input to a frequency dividing unit 491. The signal is divided into a signal with a set frequency, and output to the CPU 42 to be used for normal purposes. The other signal is input to a logical slowing/quickening unit 492 (signal adjusting unit) and input to an AND circuit 492*b* with the input control signal input through an inverter 492*a*.

Usually, the control signal is a low level signal and the signal is converted to the high level signal in the inverter 492*a* to be input to the AND circuit 492*b*. Therefore, in this case, the clock signal input to the AND circuit 492*b* is output as is. The CPU 42 refers to the logical slowing/quickening setting storage unit 44*c* and switches the signal to the high level signal for each predetermined step. The signal is input through the inverter 492*a* and the low level signal is input in the AND circuit 492*b*. With this, the input high level signal is suitably converted to the low level, and the output of the high level signal is thinned. The high level signal is output from the CPU 42 so that the number of high level signals counted by the time keeping circuit 50 for each predetermined amount of time (for example, 1 second, 10 seconds, 1 minute) is accurate, and the timing of output within the predetermined amount of time is suitably set. The setting can be included in the logical slowing/quickening setting storage unit 44*c* or can be included in a program for executing the logical slowing/quickening.

The timekeeping circuit 50 is a counter. The timekeeping circuit 50 counts the input high level signal as a result of the above described thinning by passing through the AND circuit 492*b* of the frequency dividing circuit 49, and adds the count to the initial set time to count the present time. The present time data stored in the timekeeping circuit 50 can be calibrated by a control instruction from the CPU 42.

The power source unit 51 supplies a predetermined driving voltage to the CPU 42 and various voltages necessary to drive the display unit 45 to the display driver 46. For example, in order to drive the display unit 45 at ⅓ B (bias), the power source unit 51 supplies to the display driver 46 ground voltage (VO) and three levels of driving voltage (V3, V2=V3×⅔, V1=V3×⅓).

The temperature sensor 52 is a sensor which measures a temperature of a predetermined portion inside the radio-controlled timepiece 1 or a predetermined component such as the CPU 42. The temperature sensor 52 is a small digital sensor and can be formed and provided on one chip together with the CPU 42 and the RAM 43.

The display unit 45 is able to display time data with digital display, and includes, for example, a liquid crystal display (LCD) which is able to display numerals and characters with segments. The display unit 45 can include other types of display, such as a dot matrix type display or an organic EL (Electroluminescent) display.

The display driver 46 is an LCD driver which outputs the voltage signal to display the time on the LCD of the display unit 45 based on the control signal from the CPU 42 and to display other information. When the display unit 45 includes a display other than a segment type LCD, a driver corresponding to the display is provided. The display driver 46 stores a predetermined number (for example, 4) of COM (common) voltage signal waveforms and a predetermined number (for example, 8) of SEG (Segment) voltage signal waveforms.

FIG. 4A to 4I are diagrams showing examples of output voltage signal waveforms of COM voltage signal waveforms, SEG voltage signal waveforms, and a combination thereof set to be able to be output by the display driver 46 of the present embodiment.

Figure 4A:
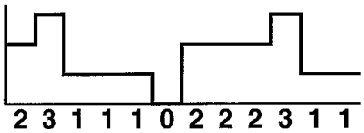
Figure 4B:
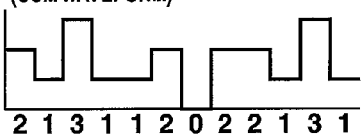
Figure 4C:
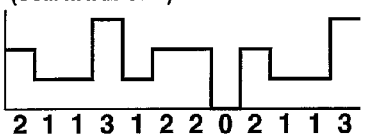
Figure 4D:
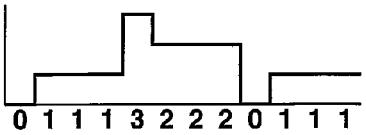
Figure 4E:
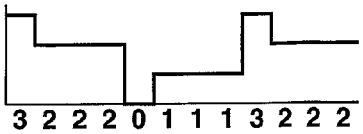
Figure 4F:
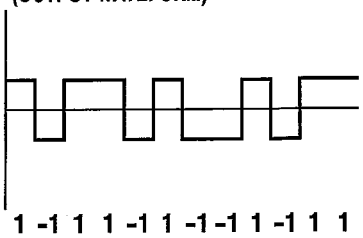
Figure 4G:
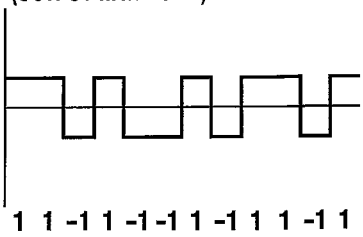
Figure 4H:
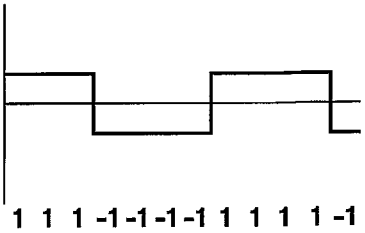
Figure 4H:
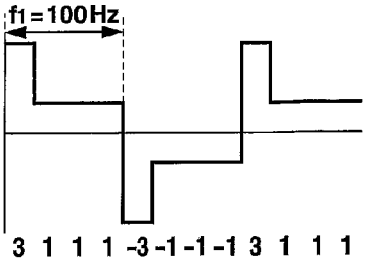

The COM voltage signal waveforms (FIG. 4A to FIG. 4D) are combined with the selectively output SEG voltage signal waveform (FIG. 4E) to determine output voltage signal waveforms (FIG. 4F to FIG. 4I) from the difference of voltage between the COM voltage and the SEG voltage and with this, each segment of the LCD of the display unit 45 is turned on and off. In a normal state, the display driver 46 of the present embodiment outputs ¼ D (duty) of the COM voltage signal waveform and the SEG voltage signal waveform at a frame frequency f1=100 Hz (frame period 10 ms) (FIG. 4I). In the output voltage signal, waveform, the waveform of this frame period and a waveform with the positive and negative inverted appear successively. Therefore, the output voltage signal is to be a period signal of 50 Hz which is half of the frame frequency f1 and the display unit 45 is driven with this frequency (driving waveform frequency). According to the combination of the segments turned on in the display unit 45, the SEG voltage signal waveform is determined and stored in the display driver 46.

Here, the clock signal for the display driver 46 to output the driving signal is input without processing regarding logical slowing/quickening from the oscillating circuit 48. Therefore, there is a slight (for example, 100 ppm) deviation (error, hereinafter referred to as oscillating frequency error) from 32 kHz.

Next, the control operation of the driving waveform frequency which drives the display unit 45 in the radio-controlled timepiece 1 of the present embodiment is described.

As described above, usually, the display driver 46 of the present embodiment uses duty drive with the driving waveform frequency of 50 Hz to drive the display unit 45. Therefore, electromagnetic noise is generated at 50 Hz and its higher order harmonic frequencies, in other words, frequencies in integral multiples of 50 Hz. Turning to the standard radio wave received using the radio wave receiving unit 41 and the antenna ANT, the transmitting frequency of each station is a frequency in integral multiples of 50 Hz, for example, JJY of Japan (40 kHz, 60 kHz), WWVB of the United States (60 kHz), MSF of the United Kingdom (60 kHz), and DCF 77 of Germany (77.5 kHz). Therefore, the noise is mixed when the standard radio wave is received.

The CPU 42 performs processing to change the driving waveform frequency to a predetermined destination frequency while the standard radio wave is received so that the higher order harmonic frequency of the driving waveform frequency output from the display driver 46 does not overlap with the receiving frequency of the standard radio wave. However, there is a possibility that the clock signal oscillated by the oscillating circuit 48 of the present embodiment is different from the set frequency due to the above described oscillating frequency error. Therefore, when the oscillating frequency is not accurate, the driving waveform frequency and the destination frequency generated using the clock signal will also be different from the accurate frequency. As a result, one of the higher order harmonic frequencies of the destination frequency may overlap with the receiving frequency of the standard radio wave. Therefore, according to the radio-controlled timepiece 1 of the present embodiment, the CPU 42 refers to the logical slowing/quickening setting storage unit 44*c* and sets the destination frequency considering the oscillating frequency error of the clock signal.

FIG. 5 is a diagram showing an example of setting of the driving waveform frequency during the period that the standard radio wave is received, the setting which is stored in the standard radio wave receiving setting unit 44*b* of the present embodiment.

In the standard radio wave receiving setting unit 44*b*, the destination frequency of the driving waveform frequency in the standard radio wave reception is set associated with the oscillating frequency error (here, the positive value is to be the value toward the reducing direction of the frequency). Here, it is shown that in receiving JJY 60 (transmitting frequency 60 kHz), when the oscillating frequency error is equal to or more than 0 ppm and less than 50 ppm, the destination frequency is set to 74 Hz, and when the oscillating frequency error is equal to or more than 50 ppm and equal to or less than 100 ppm, the destination frequency is set to 74.2 Hz.

Although not limited, here, the destination frequency is set to a frequency higher than the original driving waveform frequency. With this, the interval of the higher order harmonic frequencies of the destination frequency can be set larger than normal situations. Therefore, the possibility that the higher order harmonic frequencies above and below the receiving frequency of the standard radio wave overlap with the receiving frequency becomes smaller.

Figure 6:
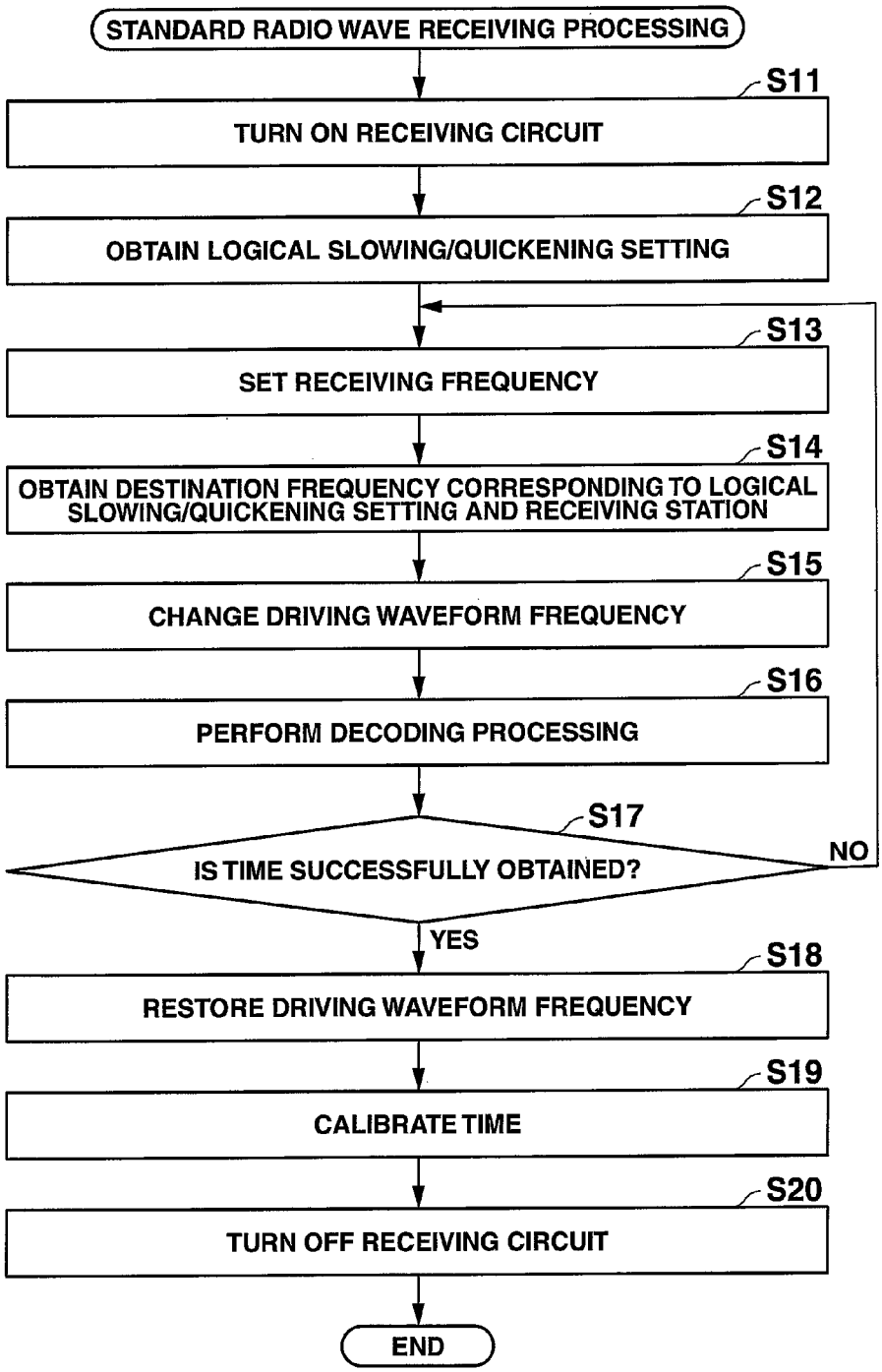
FIG. 6 is a flowchart showing control process of standard radio wave receiving processing.

FIG. 6 is a flowchart showing a process of control by the CPU 42 in the standard radio wave receiving processing executed in the radio-controlled timepiece 1 of the present embodiment.

The standard radio wave receiving processing starts by automatically calling at a predetermined time every day, or by manually starting according to operation of input on the operation unit 47 by the user. In the standard radio wave receiving processing, first the CPU 42 transmits a signal to the power source unit 51 and turns on the supply of power to the radio wave receiving unit 41 (step S11).

Next, the CPU 42 refers to the logical slowing/quickening setting storage unit 44*c*, and obtains the thinning setting regarding the logical slowing/quickening (step S12). The CPU 42 sets the standard radio wave transmitting station which is to be the receiving target, obtains its transmitting frequency, and sets the tuning frequency for receiving the radio wave (step S13). The CPU 42 refers to the standard radio wave setting unit 44*b*, and obtains the destination frequency which is the driving waveform frequency of the LCD during the period that the standard radio wave is received based on the obtained thinning setting and the tuning frequency (step S14). The CPU 42 transmits the control signal to the display driver 46, and changes the driving waveform frequency to the obtained destination frequency (step S15).

The CPU 42 decodes the TCO received and demodulated with the radio wave receiving unit 41, and obtains the time information (step S16). The CPU 42 determines whether the CPU 42 obtained the time information successfully (step S17). If the CPU 42 determines that the time information is not obtained successfully, in other words, the CPU 42 failed (step S17, "NO"), the CPU 42 returns the processing to step S13, changes the receiving target to another standard radio wave transmitting station, and repeats the processing of steps S13 to S17.

When the CPU 42 determines that the time information is obtained successfully (step S17 "YES"), the CPU 42 transmits a control signal to the display driver 46 and restores the driving waveform frequency changed to the destination frequency to the original frequency (step S18). The CPU 42 outputs the accurate present time data based on the obtained time information to the time keeping circuit 50 and calibrates the time (step S19). Then, the CPU 42 transmits a signal to the power source unit 51 to turn off the power of the radio wave receiving unit 41 (step S20), and ends the standard radio wave receiving processing.

According to the above, the radio-controlled timepiece 1 of the present embodiment includes the oscillating circuit 48 which outputs the clock signal, the display unit 45 which displays with the digital display, a display driver 46 which drives the display unit 45 with the driving waveform signal of the predetermined driving waveform frequency generated by the clock signal, the logical slowing/quickening setting storage unit 44*c* which stores data regarding the deviation of the oscillating frequency of the clock signal (oscillating frequency error), and the radio wave receiving unit 41 and antenna ANT which tunes to the receiving frequency of the standard radio wave and receives the standard radio wave as the receiving target. The radio-controlled timepiece 1 refers to the data regarding the oscillating frequency error stored in the logical slowing/quickening setting storage unit 44*c* and sets the destination frequency according to the amount of error during the period that the standard radio wave is received by the radio wave receiving unit 41 and the antenna ANT so that the receiving frequency of the standard radio wave does not overlap with the higher order harmonic frequencies of the driving waveform frequency. In other words, even when a small and cheap oscillating circuit 48 which does not always have an accurate oscillating frequency is used, it is possible to easily and reliably change the higher order harmonic frequencies of the driving waveform frequency from the receiving frequency of the standard radio wave. Therefore, it is possible to receive the standard radio wave more reliably to obtain time information while continuing digital display.

Moreover, based on the data regarding the oscillating frequency error stored in the logical slowing/quickening setting storage unit 44*c*, the radio-controlled timepiece 1 can thin the signal in the amount of the deviation of the oscillating frequency from the clock signal output from the oscillating circuit 48 at a preset timing, and input the clock signal to the time keeping circuit 50. Therefore, with the time keeping circuit 50, the radio-controlled timepiece 1 can count the accurate time with the logical slowing/quickening performed. Then, the data regarding oscillating frequency error used in the logical slowing/quickening can be used to set the destination frequency of the driving waveform frequency in receiving the standard radio wave. Therefore, a configuration to accurately adjust the oscillating frequency of the oscillating circuit 48 is not necessary. Moreover, there is no need to obtain and hold data regarding the deviation of the oscillating frequency separate from the setting regarding the logical slowing/quickening. Therefore, it is possible to accurately count the time and to receive the standard radio wave with high receiving sensitivity.

The destination frequency corresponding to the amount of oscillating frequency error is stored in advance as a table in the standard radio wave receiving setting unit 44*b*, and in receiving the standard radio wave, the corresponding destination frequency is obtained from the standard radio wave receiving setting unit 44*b* based on the amount of oscillating frequency error obtained from the logical slowing/quickening setting storage unit 44*c*. Therefore, the suitable destination frequency can be set easily, and the standard radio wave can be received with good sensitivity while continuing digital display without troublesome calculation each time.

The table can be stored in the standard radio wave receiving setting unit 44*b* for each receiving frequency of the standard radio wave. Therefore, even if the standard radio wave is received from different standard radio wave transmitting stations throughout the world, the standard radio wave can be received reliably without problems.

In the radio-controlled timepiece 1, during the period that the standard radio wave is received, the destination frequency is set to a frequency higher than the original driving waveform frequency. Therefore, by enlarging the interval between adjacent higher order harmonic frequencies, the influence of the noise of these higher order harmonic frequencies can be effectively reduced when receiving the standard radio wave.

The radio-controlled timepiece 1 includes a temperature sensor 52, and the logical slowing/quickening setting storage unit 44*c* stores both the static error which is the deviation unique to the oscillating circuit 48 and the variable error showing the amount of deviation which changes depending on the temperature. When the standard radio wave is received, the radio-controlled timepiece 1 sets the destination frequency according to the total amount of deviation calculated based on the temperature measured by the temperature sensor 52. Therefore, even in the radio-controlled timepiece 1 which includes a small and cheap oscillating circuit 48 not including the temperature compensation circuit, a more accurate amount of oscillating frequency error of the clock signal output from the oscillating circuit 48 can be obtained, and the standard radio wave can be received reliably while continuing digital display, even if the temperature changes under various environments.

The present invention is not limited to the above described embodiments, and various modifications are possible.

For example, according to the present embodiment, the destination frequency is individually set for each receiving frequency. However, one common table can be provided to set a suitable destination frequency common to all receiving frequencies.

According to the present embodiment, the driving waveform frequency is changed while receiving the standard radio wave. However, it is possible to set the configuration so that the driving waveform frequency is not changed when the higher order harmonic frequencies of the driving waveform frequencies including the influence of the deviation of the oscillating frequency is not in the range which overlaps with the receiving frequency of the standard radio wave from the beginning. For example, when the amount of oscillating frequency error is within a predetermined range, it is possible to preset the driving waveform frequency so that there is no need to change the driving waveform frequency. In this case, processing to change the driving waveform frequency to the preset destination frequency is performed only when the amount of oscillating frequency error is outside the predetermined range.

According to the present embodiment, the standard radio wave receiving setting unit 44*b* is referred and the frequency is set to a predetermined destination frequency, however, the frequency can be calculated individually each time.

According to the present embodiment, the temperature of the CPU 42, etc. is considered. However, the radio-controlled timepiece 1 can be a configuration which does not include the temperature sensor 52 and sets the destination frequency considering only the deviation unique to the oscillating circuit 48 when the applied oscillating circuit 48 includes a temperature compensation circuit or when the driving waveform frequency is set to a driving waveform frequency where the necessity of considering the influence of the temperature change is small.

According to the above embodiment, data of thinning setting in logical slowing/quickening is used to consider the oscillating frequency error of the oscillating circuit 48. However, separate data regarding the deviation of the oscillating frequency can be stored and held.

The specific details such as the configuration, circuit, and processing as described in the present embodiment can be suitably modified without leaving the scope of the present invention.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2013-111433 filed on May 28, 2013 including specification, claims, drawings and abstract are incorporated herein by reference in its entirety.

What is claimed is:

1. A radio-controlled timepiece comprising:

an oscillating unit which outputs a clock signal;

a display unit which displays with a digital display;

a display driving unit which drives the display unit with a driving signal of a predetermined driving waveform frequency generated by the clock signal;

an error storage unit which stores error data of an oscillating frequency of the clock signal;

a radio wave receiving unit which tunes to a receiving frequency of a radio wave including time information, and receives the radio wave;

a change setting storage unit which stores, as a table, an amount of error associated with a driving waveform frequency to be changed to when the radio wave is received, for each receiving frequency of the radio wave which is a receiving target of the radio wave receiving unit;

a frequency setting unit which refers to the error storage unit to obtain the error data, which sets the receiving frequency of the radio wave which is the receiving target of the radio wave receiving unit, which sets the driving waveform frequency by referring to the change setting storage unit so that the receiving frequency of the radio wave does not overlap with a higher order harmonic wave of the driving waveform frequency during a period that the radio wave is received by the radio wave receiving unit, and which restores the driving waveform frequency to the predetermined driving waveform frequency in a period other than during the period that the radio wave is received by the radio wave receiving unit;

a dividing circuit which divides the clock signal to generate and output a signal with a necessary frequency; and a timekeeping unit which counts the signal output from the dividing circuit, wherein the dividing circuit includes:

a dividing unit which divides the clock signal into two systems, and divides and outputs a first signal and a second signal, the first signal having a set frequency; and a signal adjusting unit which outputs, at a predetermined timing, an adjusting signal in which a signal in an amount of the error is removed from the second signal.

2. The radio-controlled timepiece according to claim 1, wherein the driving waveform frequency which is changed during the period that the radio wave is received is set higher than the driving waveform frequency which is not changed.

3. The radio-controlled timepiece according to claim 2, further comprising a temperature measuring unit which measures a temperature, wherein the error stored in the error storage unit includes a static error unique to the oscillating unit and a variable error depending on the temperature, and wherein the frequency setting unit calculates the error based on the measured temperature, and changes the driving waveform frequency based on the calculated error.

4. The radio-controlled timepiece according to claim 1, further comprising a temperature measuring unit which measures a temperature, wherein the error stored in the error storage unit includes a static error unique to the oscillating unit and a variable error depending on the temperature, and wherein the frequency setting unit calculates the error based on the measured temperature, and changes the driving waveform frequency based on the calculated error.

* * * * *